US009347304B2

(12) United States Patent
Lugo et al.

(10) Patent No.: US 9,347,304 B2
(45) Date of Patent: May 24, 2016

(54) SYSTEM AND METHOD FOR HIGH SPEED HYDRAULIC ACTUATION

(75) Inventors: Mario R. Lugo, The Woodlands, TX (US); Ryan D. Fontenot, Houston, TX (US); Syed M. Rashid Ali, Huntington Beach, CA (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 14/237,145

(22) PCT Filed: Jul. 5, 2012

(86) PCT No.: PCT/US2012/045573

§ 371 (c)(1),
(2), (4) Date: Feb. 4, 2014

(87) PCT Pub. No.: WO2013/032577

PCT Pub. Date: Mar. 7, 2013

(65) Prior Publication Data

US 2014/0174751 A1 Jun. 26, 2014

Related U.S. Application Data

(60) Provisional application No. 61/528,523, filed on Aug. 29, 2011.

(51) Int. Cl.

| | |
|---|---|
| ***E21B 7/12*** | (2006.01) |
| ***E21B 43/36*** | (2006.01) |
| ***F15B 13/043*** | (2006.01) |
| ***E21B 34/04*** | (2006.01) |
| ***E21B 43/01*** | (2006.01) |

(52) U.S. Cl.
CPC ..... *E21B 43/36* (2013.01); *E21B 34/04* (2013.01); *E21B 43/01* (2013.01); *F15B 13/0433* (2013.01)

(58) Field of Classification Search
CPC ..... E21B 34/04; E21B 43/01; E21B 43/36
USPC ..... 166/335, 357
See application file for complete search history.

(56) References Cited

U.S. PATENT DOCUMENTS 3,633,667 A * 1/1972 Falkner, Jr. ..... 166/366
4,281,682 A 8/1981 Satoh (Continued)

FOREIGN PATENT DOCUMENTS

GB 2044892 10/1980

OTHER PUBLICATIONS www.maintenanceresources.com/referencelibrary/ezine/ Maintenance Resources.com, monthly on-line magazine, Feb. 4, 2014, 13 pages.

(Continued)

*Primary Examiner* — Matthew R Buck
*Assistant Examiner* — Aaron Lembo
(74) *Attorney, Agent, or Firm* — ExxonMobil Upstream Research-Law Department

(57) ABSTRACT

There is provided a device and method for high speed hydraulic actuation. The method includes adjusting a position of an actuator using a hydraulic pressure regulator. Adjusting the position of the actuator includes increasing pressure on the hydraulic pressure regulator to open the actuator using a first solenoid, or decreasing pressure on the hydraulic pressure regulator to close the actuator using a second solenoid.

20 Claims, 5 Drawing Sheets

(56) References Cited

U.S. PATENT DOCUMENTS

| | | | | |
|---|---|---|---|---|
| 4,467,833 | A * | 8/1984 | Satterwhite et al. | 137/637 |
| 4,668,024 | A * | 5/1987 | Nakanishi et al. | 303/119.3 |
| 6,663,361 | B2 * | 12/2003 | Kohl et al. | 417/417 |
| 6,729,130 | B1 | 5/2004 | Lilleland | |
| 6,983,922 | B2 * | 1/2006 | Watson | 251/30.01 |
| 6,988,554 | B2 * | 1/2006 | Bodine et al. | 166/363 |
| 7,013,978 | B2 | 3/2006 | Appleford et al. | |
| 7,137,450 | B2 * | 11/2006 | Johansen et al. | 166/316 |
| 7,159,662 | B2 * | 1/2007 | Johansen et al. | 166/374 |
| 7,216,715 | B2 * | 5/2007 | Reynolds | 166/339 |
| 7,237,472 | B2 | 7/2007 | Cove | |
| 7,503,385 | B2 * | 3/2009 | Tips et al. | 166/72 |
| 2005/0045237 | A1 | 3/2005 | Dean | |
| 2005/0178560 | A1 | 8/2005 | Johansen et al. | |
| 2006/0150935 | A1 * | 7/2006 | Donaldson | 123/90.12 |
| 2007/0111855 | A1 * | 5/2007 | Voigt | 477/156 |
| 2008/0135258 | A1 | 6/2008 | Daniel et al. | |
| 2009/0107682 | A1 | 4/2009 | Davis | |
| 2012/0234550 | A1 * | 9/2012 | Dietz et al. | 166/344 |
| 2013/0199792 | A1 * | 8/2013 | Backes | 166/335 |
| 2014/0090734 | A1 * | 4/2014 | Kusko et al. | 137/624.27 |

OTHER PUBLICATIONS http://www.johnsonelectric.com/en/products/motion/solenoids.html Johnson Electric, "Solenoids", Mar. 11, 2011, 2 pages.

Gorgs K-J et Al. Elektrohydraulische stetigwegeventile mit sicherheitsverantwortung (originally in German) English Translation provided.

* cited by examiner

100

200

300

400

500

SYSTEM AND METHOD FOR HIGH SPEED HYDRAULIC ACTUATION

CROSS-REFERENCE TO RELATED APPLICATION

This application is the National Stage of International Application No. PCT/US2012/045573, filed 5 Jul. 2012, which claims the priority benefit of U.S. Provisional Patent Application 61/528,523 filed 29 Aug. 2011 entitled SYSTEM AND METHOD FOR HIGH SPEED HYDRAULIC ACTUATION, the entirety of which is incorporated by reference herein.

FIELD

The subject innovation relates to providing high speed hydraulic actuation. In particular, the subject innovation provides a system and method for high speed hydraulic actuation for a subsea well or subsea processing facility.

BACKGROUND

This section is intended to introduce various aspects of the art, which may be associated with embodiments of the disclosed techniques. This discussion is believed to assist in providing a framework to facilitate a better understanding of particular aspects of the disclosed techniques. Accordingly, it should be understood that this section is to be read in this light, and not necessarily as admissions of prior art.

Hydrocarbons are generally produced using a series of pipelines to transfer the hydrocarbons from a wellhead to production facilities. The production of hydrocarbons is controlled using pressure and flow rates within the pipelines, which may be referred to as process control. Topside process control is typically accomplished by throttling a gas or liquid stream through a control valve in order to control pressure or flow rates. However, subsea valve technology may not operate using topside control valves due to the harsh environmental conditions that occur subsea. Likewise, pneumatic actuation may not be used in subsea process control due to subsea environmental conditions, specifically, the compressibility of air.

Electric actuation may be used in subsea process control but may not be widely used subsea due to the unproven operation of electrical actuation. As a result, electrical actuation is typically used in actuators which provide only on/off or stepping control functions.

Hydraulically controlled chokes may also be used to throttle flow streams subsea. Choke valves are discretely positioned to predetermined points and travel at relatively slow speeds. As a result, hydraulic controls in choke valves are unable to accommodate changes in a flow stream at the response speeds needed for efficient process control.

Alternatively, subsea pump assisted hydraulic circuits may be used to throttle flow streams. In this scenario, a hydraulic circuit may be supplemented with the use of a subsea pump to boost the flow rate to the valve for open and close functions. However, the pump exhibits a slow response at the start of the valve cycle, approximately for 2%-10% of the valve movement. Further, the pump motor may be extremely stressed during service, and may lack high reliability. As such, the pump has a possibility of increased operation and maintenance requirements. Various examples of techniques avoid such slow valve movements are discussed in the paragraphs to follow.

U.S. Pat. No. 7,237,472 by Cove (hereinafter "Cove"), discloses a linear hydraulic stepping actuator with fast close capabilities. A choke system with hydraulic circuits may provide choke valve positioning that can be varied by the use of incremental steps. The incremental movement action in either the opening or closing direction may be accomplished through the use of one of the two hydraulic slave cylinders. A fast close system may be used which may provide valve control in a fast close line to move the choke actuator to the full closed position from anywhere in the travel over a shorter period of time than through normal stepping operation, instead of running through a series of steps to close the valve. However, even in the presence of a fast close line to move the choke actuator to full closed position, a choke system is unable to accommodate changes in a flow stream at the response speeds necessary for efficient process control.

U.S. Pat. No. 6,729,130 by Lilleland (hereinafter "Lilleland"), discloses a device in a subsea system for controlling a hydraulic actuator and a subsea system with a hydraulic actuator. The hydraulic actuator may be connected to a supply line for supply of a supply fluid to the actuator and a return line for removal of a return fluid from the actuator. However, the supply fluid to the hydraulic actuator may not be enough to ensure the response speeds for efficient process control.

SUMMARY

An embodiment of the present techniques includes a device for high speed hydraulic actuation. An example of the device includes a hydraulic pressure regulator used to adjust a position of an actuator, a first solenoid configured to increase pressure on the hydraulic pressure regulator to open the actuator, and a second solenoid configured to decrease pressure on the hydraulic pressure regulator to close the actuator. The device may also include a control valve configured to be moved in response to the position of the actuator.

An embodiment of the present techniques includes a method for high speed hydraulic actuation, comprising adjusting a position of an actuator using a hydraulic pressure regulator. Adjusting the position of the actuator may include increasing pressure on the hydraulic pressure regulator to open the actuator using a first solenoid, or decreasing pressure on the hydraulic pressure regulator to close the actuator using a second solenoid.

An embodiment of the present techniques includes a method for harvesting hydrocarbons from a subsea wellhead, comprising connecting wellbore fluids from the wellhead to a three phase separator. Pressure data and fluid level data may be sent from the subsea separator to a subsea control module and a master control station. Set-points may be determined at the master control station or at the subsea control module using a proportional-integral-derivative loop within the subsea control module. Based on the set-points, a hydraulic pressure from a hydraulic pressure regulator may be controlled with a pair of solenoids by increasing pressure on the hydraulic pressure regulator to open the actuator using a first solenoid, or decreasing pressure on the hydraulic pressure regulator to close the actuator using a second solenoid. A control valve may be adjusted based on the hydraulic pressure from the pair of solenoids and an actuator.

DESCRIPTION OF THE DRAWINGS

Advantages of the present techniques may become apparent upon reviewing the following detailed description and drawings of non-limiting examples of embodiments in which.

DETAILED DESCRIPTION

Figure 1:
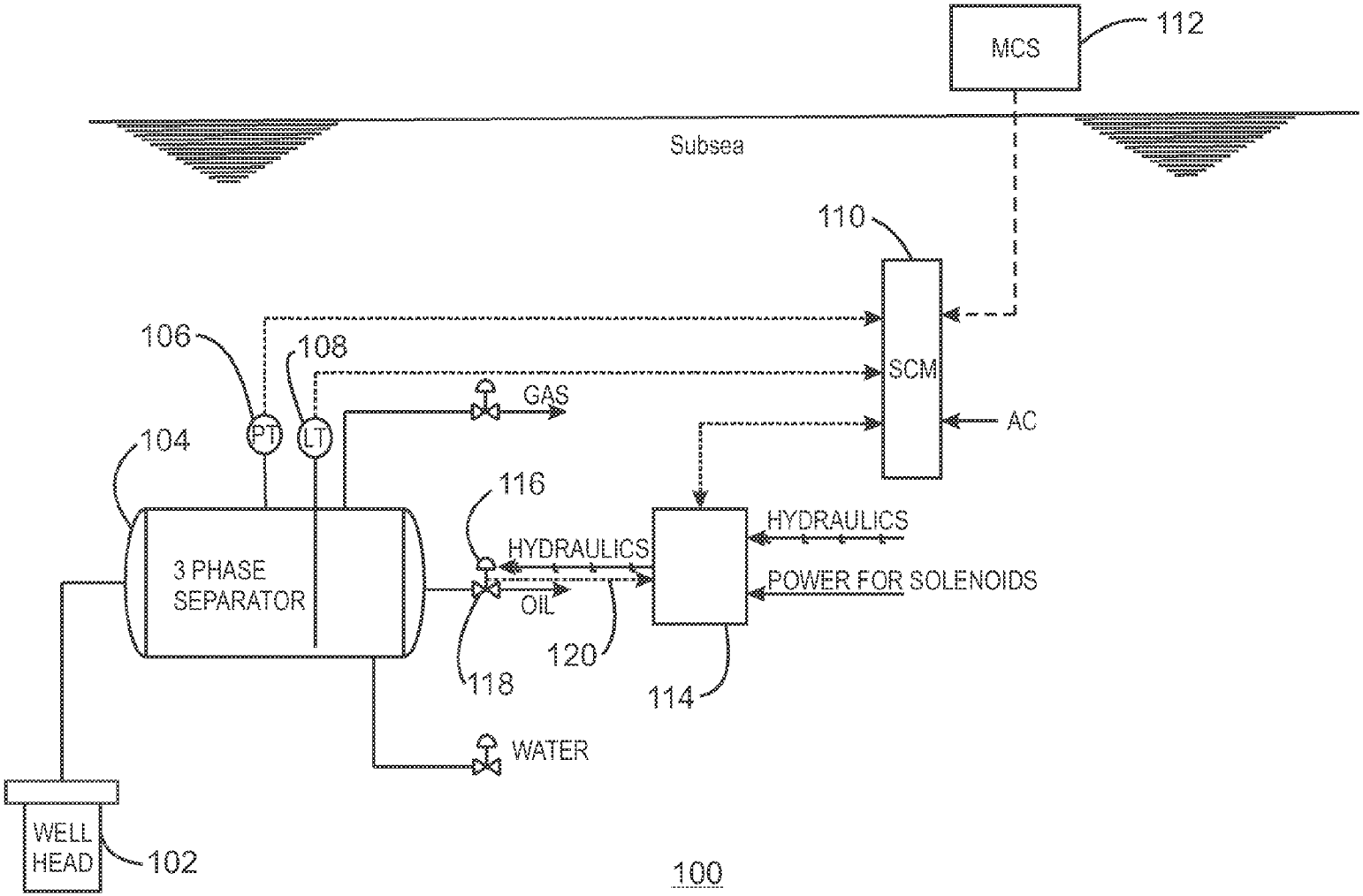
FIG. 1 is a diagram showing a system providing subsea process control according to an embodiment of the present techniques.

In the following detailed description section, specific embodiments are described in connection with preferred embodiments. However, to the extent that the following description is specific to a particular embodiment or a particular use, this is intended to be for exemplary purposes only and simply provides a description of the exemplary embodiments. Accordingly, the present techniques are not limited to embodiments described herein, but rather, it includes all alternatives, modifications, and equivalents falling within the spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent.

The term "control system" refers to one or more physical system components employing logic circuits that cooperate to achieve a set of common process results. For example, in an operation of a gas turbine engine, the objectives can be to achieve a particular exhaust composition and temperature. The control system can be designed to reliably control the physical system components in the presence of external disturbances, variations among physical components due to manufacturing tolerances, and changes in inputted set-point values for controlled output values. Control systems usually have at least one measuring device, which provides a reading of a process variable, which can be fed to a controller, which then can provide a control signal to an actuator, which then drives a final control element acting on, for example, an oxidant stream. The control system can be designed to remain stable and avoid oscillations within a range of specific operating conditions. A well-designed control system can significantly reduce the need for human intervention, even during upset conditions in an operating process.

A "proportional-integral-derivative" (PID) controller is a controller using proportional, integral, and derivative features in the process control system. In some cases the derivative mode may not be used, or its influence is reduced significantly, so that the controller may be deemed a PI controller. There are existing variations of PI and PID controllers, depending on how the discretization is performed. These known and foreseeable variations of PI, PID and other controllers are considered useful in practicing the methods and systems of the invention.

The term "subsea" refers to a position below the surface of any body of water. This may include fresh water or salt water.

The term "subsea well" refers to a well that has a tree proximate to the bottom of a marine body, such as the ocean bottom.

The term "three phase separator" refers to a vessel wherein the incoming three phase feed is separated into individual fractions. Typically, the vessel has sufficient cross-sectional area so that the individual phases may be separated by gravity.

The term "valve" as used herein generally refers to a device placed in a flow stream that can be opened, closed, adjusted, altered, or throttled to change the flow characteristics of the flow stream. For example, a control valve may be continuously adjusted in response to an electrical control signal, e.g., a signal from a surface computer or from a downhole electronic controller module. The mechanism that actually changes the valve position can comprise, but is not limited to: an electric motor; an electric servo; an electric solenoid; an electric switch; a hydraulic actuator controlled by at least one electrical servo, electrical motor, electrical switch, electric solenoid, or combinations thereof; a pneumatic actuator controlled by at least one electrical servo, electrical motor, electrical switch, electric solenoid, or combinations thereof; or a spring biased device in combination with at least one electrical servo, electrical motor, electrical switch, electric solenoid, or combinations thereof. A control valve may or may not include a position feedback sensor for providing a feedback signal corresponding to the actual position of the valve.

The term "wellhead" refers to the equipment that provides the structural and pressure containing interface for well drilling and production equipment. The primary purpose of a wellhead is to provide the suspension point and pressure seals for the casing strings that run from the bottom of the well to the surface pressure control equipment. A wellhead is typically installed during drilling operations and forms an integral structure of the well. For offshore wells, the wellhead is typically referred to as a subsea wellhead.

The term "wellbore fluids" refers to refers to crude oil, produced water, natural gas, sand, and other naturally occurring solids.

An embodiment provides a system and method for high speed hydraulic action. The present techniques allow for efficient development of subsea oil fields and may be used in oil and gas production of subsea Arctic fields, allowing for efficient process control systems. Specifically, the present techniques may permit use of hydraulic pressure to open, close, or modulate a process control valve with a level of accuracy and speed not currently available for subsea applications.

FIG. 1 is a diagram showing a system 100 providing subsea process control according to an embodiment of the present techniques. Wellbore fluids from the wellhead 102 flow into a subsea separator 104. In the depicted embodiments, subsea separator 104 is be a three-phase separator. In other embodiments, the subsea separator 104 may be a two-phase gas/liquid separator or two-phase liquid/liquid separator. A pressure transmitter 106 and a level transmitter 108 monitor fluid pressure and fluid level within the subsea separator 104. The pressure transmitter 106 and the level transmitter 108 transmit information regarding the fluid pressure and fluid level to a subsea control module (SCM) 110. The SCM 110 transfers the subsea information to a master control station (MCS) 112 which is located topside. The pressure transmitter 106 and the level transmitter 108 each have desired "set points" to maintain predetermined fluid levels and pressure levels. The set points may utilize a topside proportional-integral-derivative (PID) loop for determining a desired control valve position sent to a solenoid positioner module 114 via the SCM 110. In an embodiment, the PID controller may be located in the SCM 110, and a set point may be provided by the MCS 112. The solenoid positioner module 114 may function as a positioner that conditions the hydraulic signal to a hydraulic actuator 116 to achieve the desired position of the control valve 118. Further, the solenoids used in the solenoid positioned module 114 may be variable force solenoids.

The control valve 118 may control the pressure or level within the subsea separator 104. Based upon the desired change in valve position from MCS 112, the solenoid positioner module 114 can rapidly feed pressure to the hydraulic actuator 116, or bleed pressure from the hydraulic actuator 116. In response to the change in pressure, the hydraulic actuator 116 can adjust the position of control valve 118. The position of the control valve 118 can be fed back to solenoid positioner module 114 using a valve position indicator feedback signal 120. In attempting to achieve the desired position of the control valve 118, the output of solenoid positioner module 114 may be further adjusted using the valve position indicator feedback signal 120. In some embodiments, the control valve 118 may be placed on the gas outlet stream (shown but not labeled numerically) and control the pressure in the subsea separator.

The pressure transmitter 106, level transmitter 108, SCM 110, MCS 112, solenoid positioner module 114, and valve position indicator feedback signal 120 form a "control loop" that may be responsible for the position of control valve 118. The readings of the pressure transmitter 106 and the level transmitter 108 may be iteratively compared to their desired set point at the MCS 112, prompting the MCS 112 to provide either a new or unchanged valve position to the solenoid positioner module 114. The solenoid positioner module 114 repeats the positioning routine as necessary according to MCS 112. Non-discrete, or modulated, positioning of control valve 118 may be used to keep the pressure transmitter 106 or the level transmitter 108 within a desired operating band, as defined by the set points from MCS 112.

Figure 2:
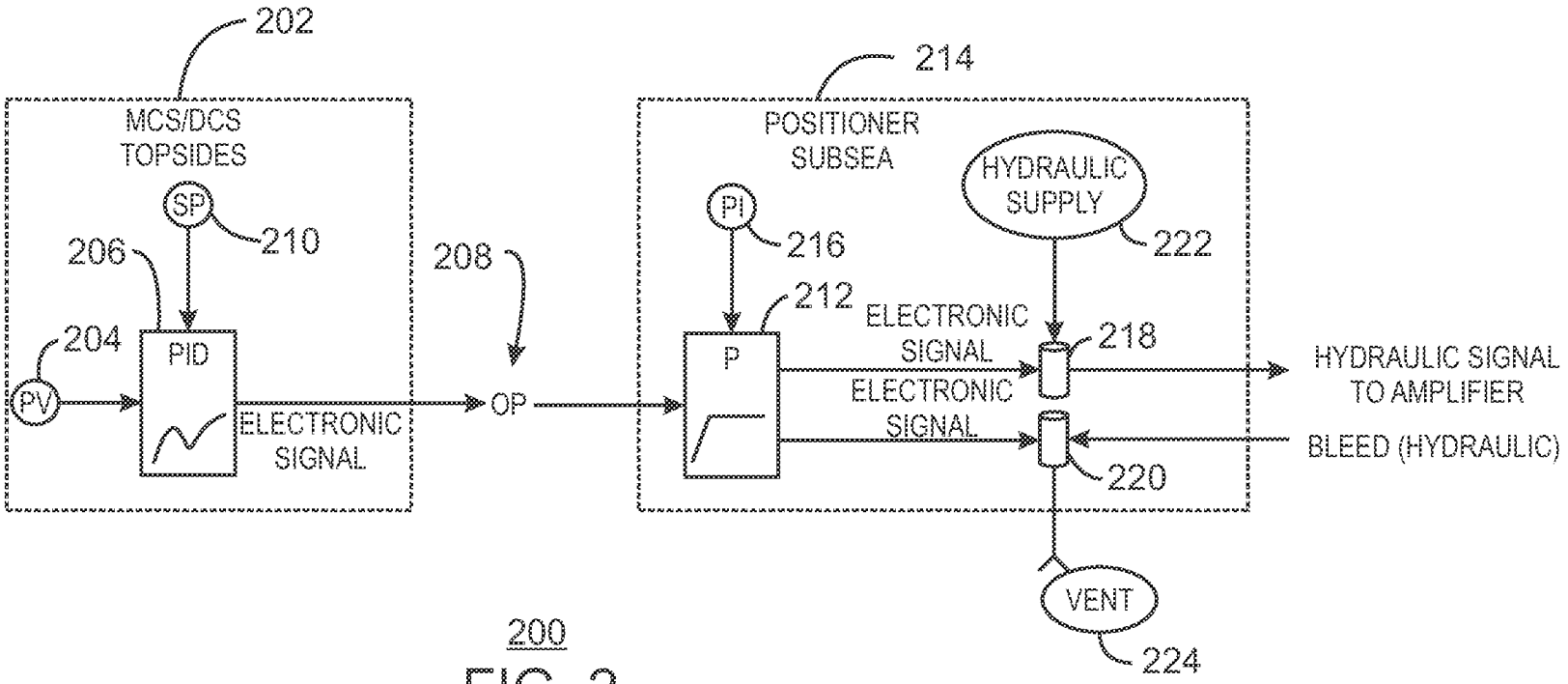
FIG. 2 is a diagram showing hydraulic modulating valve control logic according to an embodiment of the present techniques.

FIG. 2 is a diagram showing hydraulic modulating valve control logic 200 according to an embodiment of the present techniques. A master control system or a distributed control system (MCS/DCS) 202 located topside may be used in the hydraulic modulating valve control logic 200. Data 204 may arrive at a proportional-integral-derivative (PID) controller 206. The data may include process variable data such as level signal or pressure signal. Further, the PID controller 206 may be located in the MCS/DCS 202 or alternatively in a subsea control module (SCM). A valve position 208 (operating point) may be set for a subsea control valve, such as control valve 118 (FIG. 1), based upon the data 204 and a set point 210. A new valve position 208 may be computed by PID controller 206 and sent to a subsea controller 212. The new valve position 208 may also be used to maintain the set point 210 within a desired operating band.

The subsea controller 212 may be located in a positioner subsea 214. The subsea controller 212 may also receive information on the current position of a control valve, such as control valve 118 (FIG. 1), from a position indicator 216. The subsea controller 212 may then compare the set point 210 from the topside PID controller 206 to the subsea position indicator 216. Depending on the results of that comparison, the subsea controller 212 may send proportional voltage to a solenoid 218 or a solenoid 220 to move the control valve, such as control valve 118 (FIG. 1), towards an open or close position. A hydraulic supply 222 may be used to supply pressure to solenoid 218, while a vent 224 may be used to release pressure through solenoid 220.

Figure 3:
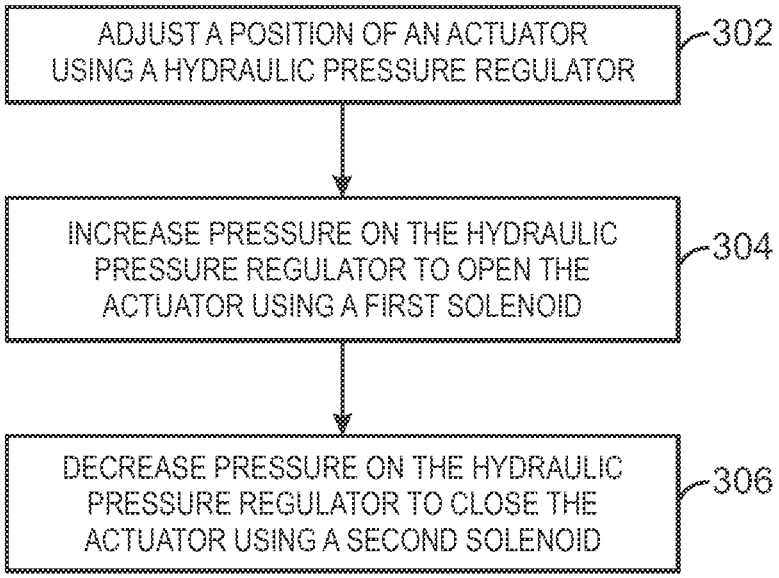
FIG. 3 is a process flow diagram summarizing a method of providing high speed hydraulic actuation according to an embodiment of the present techniques.

FIG. 3 is a process flow diagram summarizing a method 300 of providing high speed hydraulic actuation according to an embodiment of the present techniques. At block 302, a position of an actuator may be adjusted using a hydraulic pressure regulator. At block 304, the pressure on the hydraulic pressure regulator may be increased to open the actuator using a first solenoid. At block 306, the pressure on the hydraulic pressure regulator may be decreased to close the actuator using a second solenoid.

Figure 4:
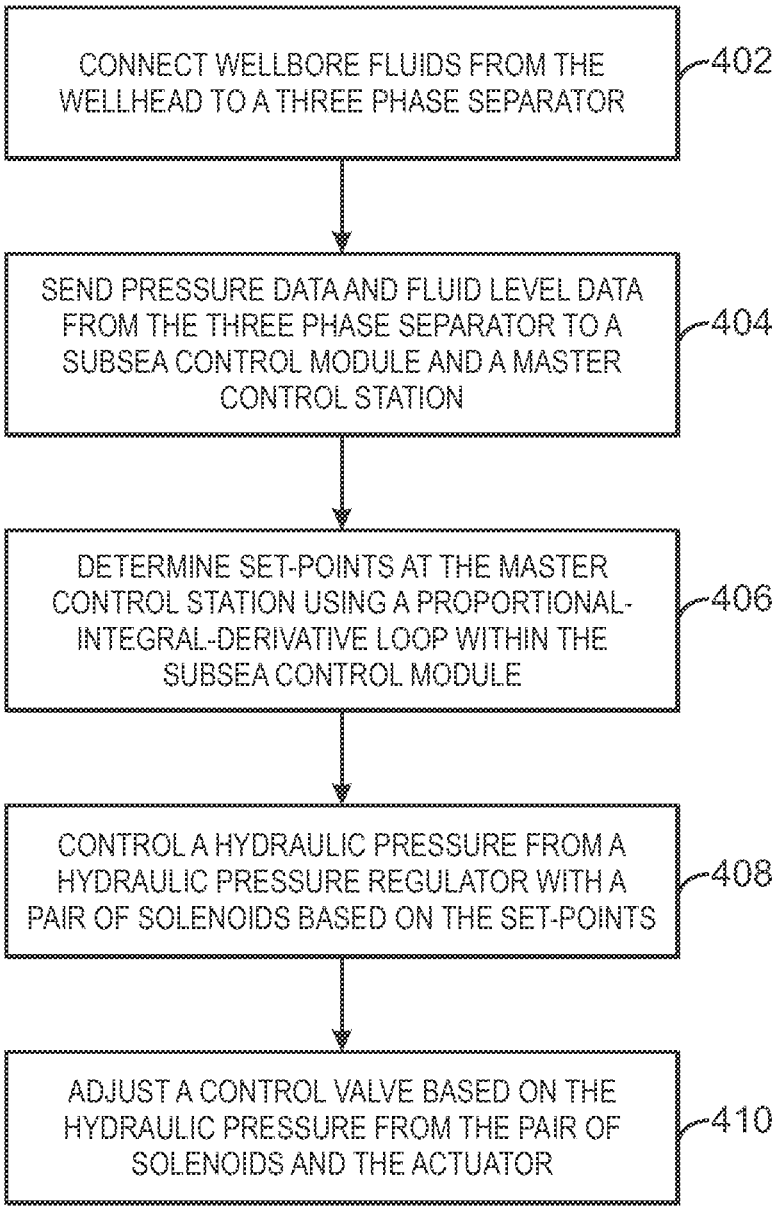
FIG. 4 is a process flow diagram summarizing a method for harvesting hydrocarbons from a subsea wellhead according to an embodiment of the present techniques.

FIG. 4 is a process flow diagram summarizing a method for harvesting hydrocarbons from a subsea wellhead according to an embodiment of the present techniques. At block 402, wellbore fluids may be connected from the wellhead to a subsea separator. At block 404, pressure data and fluid level data may be sent from the subsea separator to a subsea control module and a master control station. At block 406, set-points may be determined at the master control station using a proportional-integral-derivative loop within the subsea control module. At block 408, a hydraulic pressure from a hydraulic pressure regulator may be controlled with a pair of solenoids based on the set-points. A pressure on the hydraulic pressure regulator may be increased using a first solenoid to open an actuator or the pressure on the hydraulic pressure regulator may be decreased using a second solenoid to close the actuator. At block 410, a control valve may be adjusted based on the hydraulic pressure from the pair of solenoids and the actuator.

Figure 5:
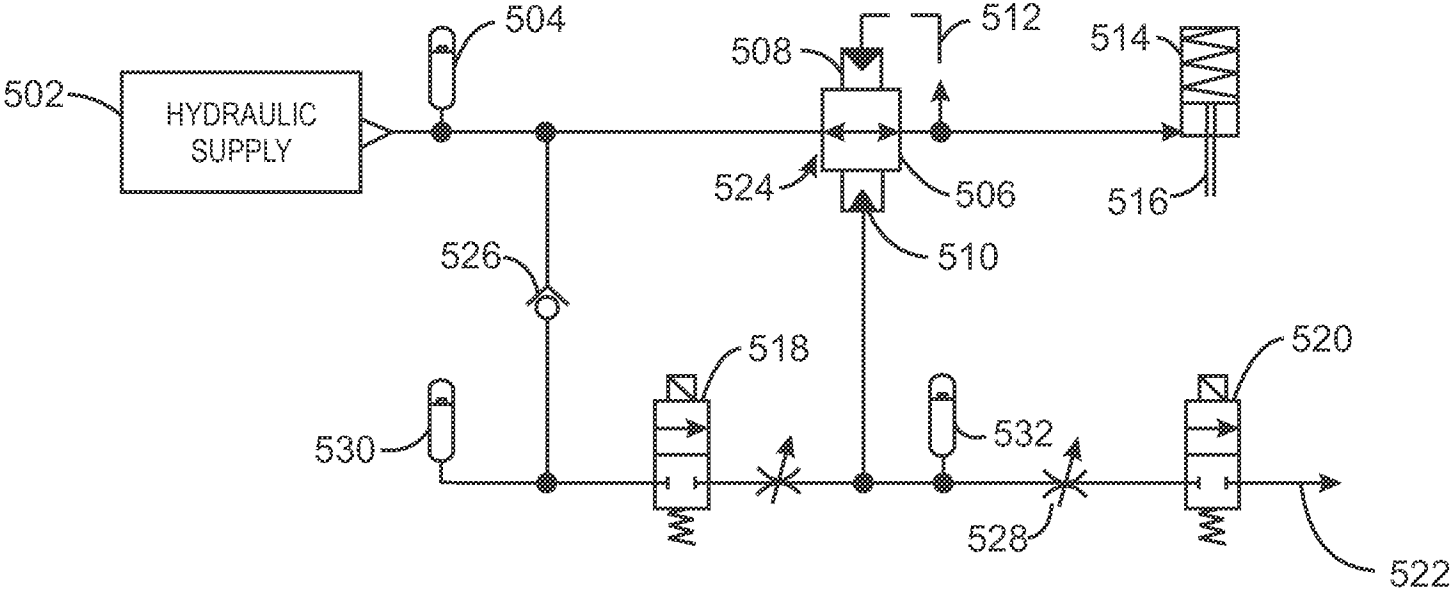
FIG. 5 is a diagram showing a solenoid configuration according to an embodiment of the present techniques.

FIG. 5 is a diagram showing a solenoid configuration 500 according to an embodiment of the present techniques. In the solenoid configuration 500, a hydraulic supply 502 may be connected to a hydraulic accumulator 504. The hydraulic accumulator 504 may supply hydraulic pressure to a hydraulic pressure regulator 506, and the hydraulic pressure regulator 506 includes an opposing pressure input port 508. The opposing pressure input port 508 counter balances input at port 510, and also acts as a feed-back mechanism for the hydraulic pressure regulator 506. A pressure sensing line 512 allows the output pressure from the actuator 514 to also feed the opposing pressure input port 508. When port 510 and the output pressure to the actuator 514 equalize, the pressure sensing line 512 allows the opposing pressure input port 508 to balance port 510 and bring the hydraulic pressure regulator 506 to a stable, static position until the port 510 changes. In this static position, pressure is neither supplied nor vented through the hydraulic regulator.

The hydraulic pressure regulator 506 may adjust the position of a control valve 516 by varying the hydraulic pressure on an actuator 514. By increasing the hydraulic pressure on the actuator 514, the control valve 516 may incrementally close. The hydraulic pressure from the hydraulic pressure regulator 506 may be controlled by increasing or decreasing hydraulic pressure on port 510 using a solenoid. The solenoids used in the solenoid configuration 500 may be variable force solenoids. When hydraulic pressure on port 510 is increased, the hydraulic regulator allows flow from the hydraulic supply into the actuator increasing the pressure in the actuator until the pressure equals 510 and balances through port 508 via line 512. When hydraulic pressure on port 510 is decreased, the hydraulic regulator 506 allows flow from the actuator out a vent port 524 on the hydraulic regulator 506 decreasing the pressure in the actuator until pressure at port 508, sensed via line 512, has decreased to that at port 510. The hydraulic regulator 506 is sized such that it allows flow of pressure either into or out of the actuator at a higher rate than if the solenoids 518 and 520 alone were supplying the pressure of port 510 directly to the actuator.

A voltage to a first solenoid 518 and a second solenoid 520 may be used to vary the hydraulic pressure to port 510. The voltage to the first solenoid 518 and the second solenoid 520 may be proportional to the difference in the current hydraulic pressure to port 510 and a desired hydraulic pressure to port 510. The first solenoid 518 and the second solenoid 520 may receive the voltage from a subsea controller, such as the SCM 110 (FIG. 1) or the subsea controller 210 (FIG. 2). As discussed herein, the subsea controller may determine the voltage by comparing a set point 208 of a system being monitored from a topside PID controller 206 to a subsea position indicator 214 (FIG. 2). The first solenoid 518 or the second solenoid 520 may open by an amount that is proportional to the voltage received from the subsea controller. Opening the first solenoid 518 may increase the hydraulic pressure on port 510, while opening the second solenoid 520 may decrease the hydraulic pressure on port 510.

To increase pressure in the system being monitored, the voltage to the first solenoid 518 may decrease as the difference between the current hydraulic pressure to port 510 and the desired hydraulic pressure to port 510 decreases, until no voltage is given. When no voltage is given, the hydraulic pressure to port 510 has resulted in a desired output on control valve 516. As the hydraulic pressure on port 510 increases, the hydraulic pressure regulator 506 may open a flow-path from the hydraulic supply to the actuator and increase the pressure on the actuator 514, thereby causing the control valve 516 to close.

To decrease pressure in the system being monitored, the second solenoid 520 may receive a voltage and open in proportion to the voltage in order to bleed hydraulic pressure using vent 522. The use of vent 522 to bleed hydraulic pressure may result in reduced hydraulic pressure to port 510. The voltage to the second solenoid 520 may decrease as the difference between the current hydraulic pressure to port 510 and the desired hydraulic pressure to port 510 decreases, until no voltage is given. When no voltage is given, hydraulic pressure to port 510 has achieved the desired output. As the hydraulic pressure on port 510 decreases, the hydraulic pressure regulator 506 releases pressure from the actuator using a vent release port 524 until pressure at port 508 has decreased to that at port 510, thereby causing the control valve 516 to open.

The hydraulic accumulator 504 may store hydraulic pressure and provide a rapid increase in pressure to improve the response time of the actuator 514. A check valve 526 may prevent any sympathetic response during high demands for hydraulic pressure to the actuator 514. A sympathetic response occurs when the demand from the hydraulic pressure regulator 506 due to input from port 510 is so great that it reduces the supply pressure significantly enough to reduce input from port 510. In sympathy, the reduction from port 510 would reduce the demand from the hydraulic pressure regulator 506. The check valve 526 may prevent the reduced supply from affecting port 510 regardless of the demand from the hydraulic pressure regulator 506.

Additionally, flow restrictors 528 may be used in order to stabilize the hydraulic pressure. An accumulator 530 and an accumulator 532 may also be used to stabilize the hydraulic pressure. The accumulator 530 along with the check valve 526 allows the control input pressure to port 510 to be independent of the demands of the hydraulic pressure regulator 506 even during high amounts of fluid consumption to the actuator 514. The accumulator 532 allows for dampening of the response to the solenoid movement, and is not required if solenoid 518 and solenoid 520 are variable force solenoids.

The present techniques allow for quick and efficient subsea process control even with long offsets. Additionally, the present techniques allow for modulating signals to be quickly controlled when using long offsets.

The present techniques may be susceptible to various modifications and alternative forms, and the exemplary embodiments discussed above have been shown only by way of example. However, the present techniques are not intended to be limited to the particular embodiments disclosed herein. Indeed, the present techniques include all alternatives, modifications, and equivalents falling within the spirit and scope of the appended claims.

What is claimed is:

1. A device for high speed hydraulic actuation, the device comprising:

an actuator;

a hydraulic pressure regulator including a hydraulic pressure input port, an opposing pressure input port, and a vent port, the hydraulic pressure regulator used to adjust the hydraulic pressure on the actuator which adjusts a position of the actuator;

a pressure sensing line allowing an output pressure of the actuator to feed the opposing pressure input port to balance the hydraulic pressure input port;

a first solenoid configured to increase pressure on the hydraulic pressure input port of the hydraulic pressure regulator to increase hydraulic pressure on the actuator, opening the actuator;

a second solenoid configured to decrease pressure on the hydraulic pressure input port of the hydraulic pressure regulator to decrease hydraulic pressure on the actuator, closing the actuator; and a control valve configured to be moved in response to the position of the actuator.

2. The device for high speed hydraulic actuation recited in claim 1, wherein the first solenoid or the second solenoid is a variable force solenoid.

3. The device for high speed hydraulic actuation recited in claim 1, wherein a check valve prevents the hydraulic control pressure from the solenoids from reacting sympathetically with the control pressure supply to the regulator.

4. The device for high speed hydraulic actuation recited in claim 1, wherein flow restrictors stabilize hydraulic pressure.

5. A method for high speed hydraulic actuation, the method comprising adjusting a position of an actuator using a hydraulic pressure regulator including a hydraulic pressure input port, an opposing pressure input port, and a vent port; and a pressure sensing line allowing an output pressure of the actuator to feed the opposing pressure input port to balance the hydraulic pressure input port, wherein adjusting the position of the actuator comprises:

increasing a pressure on the hydraulic pressure input port of the hydraulic pressure regulator using a first solenoid to increase hydraulic pressure on the actuator, opening the actuator; or decreasing the pressure on the hydraulic pressure input port of the hydraulic pressure regulator using a second solenoid to decrease hydraulic pressure on the actuator, closing the actuator.

6. The method for high speed hydraulic actuation recited in claim 5, wherein the first solenoid or the second solenoid is a variable force solenoid.

7. The method for high speed hydraulic actuation recited in claim 5, wherein a check valve prevents the hydraulic pressure from the solenoids from reacting sympathetically with the control pressure supply to the regulator.

8. The method for high speed hydraulic actuation recited in claim 5, wherein flow restrictors stabilize hydraulic pressure.

9. The method for high speed hydraulic actuation recited in claim 5, wherein the hydraulic pressure regulator supplies hydraulic pressure in order to rapidly vary hydraulic pressure on the actuator.

10. The method for high speed hydraulic actuation recited in claim 5, wherein a proportional voltage to the first solenoid or the second solenoid is used to vary hydraulic pressure on the actuator.

11. The method for high speed hydraulic actuation recited in claim 5, wherein a voltage supplied to the first solenoid or the second solenoid is determined by a subsea controller or a topside master control system.

12. A method for harvesting hydrocarbons from a subsea wellhead, the method comprising:

connecting wellbore fluids from the wellhead to a subsea separator;

sending pressure data and fluid level data from the subsea separator to a subsea control module and a master control station;

determining set-points at the master control station or the subsea control module using a proportional-integral-derivative loop within the subsea control module;

controlling a hydraulic pressure from a hydraulic pressure regulator with a pair of solenoids based on the set-points and a pressure sensing line, the hydraulic pressure regulator including a hydraulic pressure input port, an opposing pressure input port, and a vent port, and the pressure sensing line allowing an output pressure of an actuator to feed the opposing pressure input port to balance the hydraulic pressure input port, wherein:

increasing a pressure on the hydraulic pressure input port of the hydraulic pressure regulator using a first solenoid to increase hydraulic pressure on the actuator, opening the actuator; or decreasing the pressure on the hydraulic pressure input port of the hydraulic pressure regulator using a second solenoid to decrease hydraulic pressure on the actuator, closing the actuator; and adjusting the position of the actuator using the hydraulic pressure regulator.

13. The method for harvesting hydrocarbons from a subsea wellhead recited in claim 12, wherein the actuator moves a control valve in response to the position of the actuator, the control valve is used to keep pressure data and fluid level data within a desired operating band.

14. The method for harvesting hydrocarbons from a subsea wellhead recited in claim 12, wherein the first solenoid and second solenoid are both a variable force solenoid.

15. The method for harvesting hydrocarbons from a subsea wellhead recited in claim 12, wherein a check valve prevents the hydraulic pressure from the solenoids from reacting sympathetically with the control pressure supply to the regulator.

16. The method for harvesting hydrocarbons from a subsea wellhead recited in claim 12, wherein flow restrictors stabilize hydraulic pressure.

17. The method for harvesting hydrocarbons from a subsea wellhead recited in claim 12, wherein the hydraulic pressure regulator supplies hydraulic pressure in order to rapidly vary hydraulic pressure on the actuator.

18. The device for high speed hydraulic actuation recited in claim 3, further comprising a hydraulic accumulator located between the check valve and the first solenoid.

19. The method for high speed hydraulic actuation recited in claim 7, wherein a hydraulic accumulator is located between the check valve and the first solenoid.

20. The method for harvesting hydrocarbons from a subsea wellhead recited in claim 15, wherein a hydraulic accumulator is located between the check valve and the first solenoid.

* * * * *